United States Patent [19]

DePhillipo et al.

[11] Patent Number: 4,528,911

[45] Date of Patent: Jul. 16, 1985

[54] TRACER AMMUNITION

[75] Inventors: Thomas E. DePhillipo, Somerdale, N.J.; James F. Kowalick, Southampton, Pa.

[73] Assignee: LSI Technologies, Inc., Westmont, N.J.

[21] Appl. No.: 507,063

[22] Filed: Jun. 23, 1983

[51] Int. Cl.[3] ..... F42B 11/16

[52] U.S. Cl. ..... 102/513; 102/514

[58] Field of Search ..... 102/501, 503, 514-516, 102/513

[56] References Cited

U.S. PATENT DOCUMENTS

| | | | |
|---|---|---|---|
| 581,946 | 5/1897 | Simple | 102/513 |
| 734,966 | 7/1903 | Schou | 102/513 |
| 1,094,402 | 4/1914 | Keen | 102/513 |
| 3,401,636 | 9/1968 | Ciccone et al. . | |
| 3,988,990 | 11/1976 | MacDonald, Jr. et al. | 102/513 |
| 4,204,895 | 5/1980 | Webster, III | 149/20 |

OTHER PUBLICATIONS

Report R-2033, entitled "Development of Tracers for XM216 Cartridge", published by Dept. of the Army, Feb. 1972.

*Primary Examiner*—Harold J. Tudor
*Attorney, Agent, or Firm*—Steele, Gould & Fried

[57] ABSTRACT

An improved tracer ammunition round and method of manufacturing the tracer ammunition is disclosed. Each round is fabricated by first providing an elongated hole in a cord of soft metal, filling the hole with a special pyrotechnic composition and then reducing the diameter of the cord to a desired size. The cord is then cropped into round size lengths and each length is treated to provide a shaped slug with a pyrotechnic column throughout its length. The shaped slugs are then inserted into the interior cavities of shaped metallic jackets and are secured therein by crimping. The pyrotechnic column is formed of zirconium powder, potassium perchlorate and a suitable binder. The ratio of the length of the column to its diameter is between five and two hundred and the diameter of the pyrotechnic column is between 0.025 inches and 0.035 inches.

9 Claims, 7 Drawing Figures

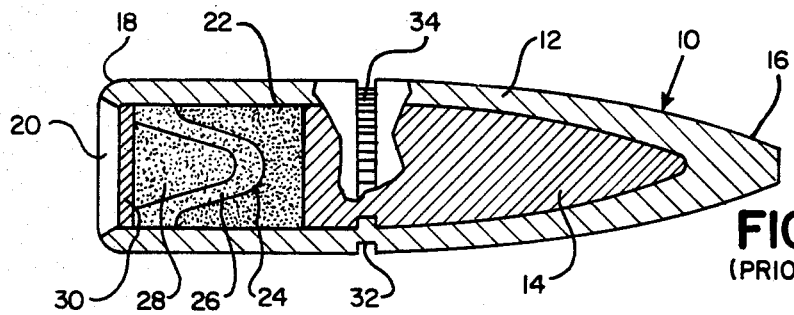
FIG. 1
(PRIOR ART)
FIG. 2
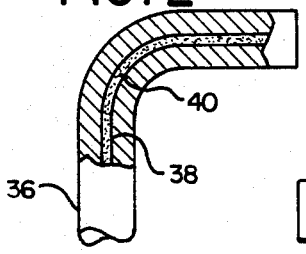
FIG. 3
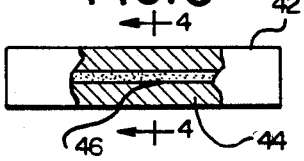
FIG. 4
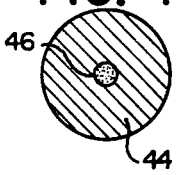
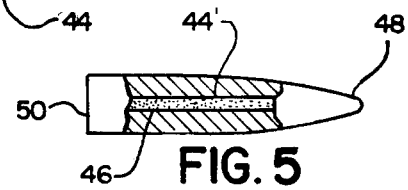
FIG. 5
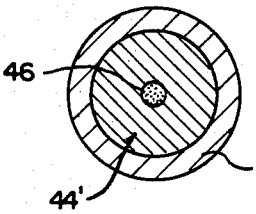
FIG. 7
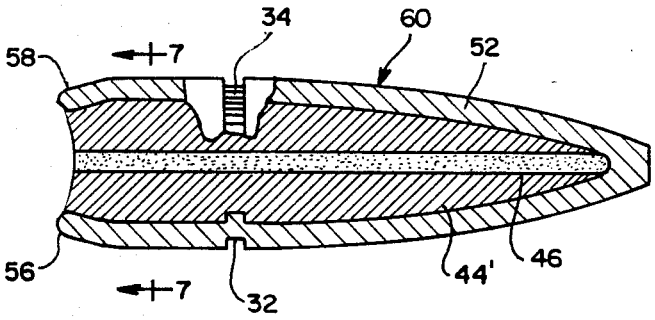
FIG. 6

TRACER AMMUNITION

FIELD OF THE INVENTION

This invention relates generally to the field of small arms and cannon caliber ammunition, and more particularly, is directed to improved tracer ammunition including an improved method of manufacture of the tracer ammunition.

BACKGROUND OF THE INVENTION

Tracer ammunition, that is, ammunition including pyrotechnic compositions, has long been employed by the military and other organizations to provide a visible "trace" of a projectile's trajectory after the projectile has been fired from a weapon. Such tracer ammunition provides visual assurance that all rounds or slugs are being delivered to the exact area wherein it is desired to direct the fire. Accordingly, for small arms, it is important that the tracer rounds be similar in size, weight and configuration to the other non-tracer rounds so that all ammunition will exhibit similar trajectories and flight patterns For cannon caliber rounds, all types of ammunition (e.g., armor-piercing, high-explosive, target-practice, etc.) will contain a tracer.

Such prior-art pyrotechnic compositions have conventionally been loaded into a hole drilled in the base of the projectile to a predetermined depth wherein the depth of the hole is related to the total visible burning time required. The visible burning time for a pyrotechnic tracer projectile is usually defined as the time over which the gunner or other observer can actually see the "trace" of the projectile. This hole in the base of the projectile is filled during the manufacturing process with a pyrotechnic powdered composition, which composition must be consolidated under extremely high compression forces, usually by employing a hydraulic or pneumatic press. This consolidation process may require several consolidation steps and may require the addition of a separate igniter composition in order to assure ignition after firing. The extremely high tamping pressures previously required in the tracer ammunition manufacturing process proved to be extremely cumbersome and difficult when encountering small cavity projectiles to thereby greatly increase production costs while at the same time decreasing reliability and predictability.

The consolidation process presently necessary to produce the currently available tracer ammunition has rendered the manufacture of such ammunition unadaptable to fast production by employment of the usual automatic ammunition manufacturing equipment. This results in the requirement to utilize special, slow functioning machines, thus considerably slowing down the production of tracer ammunition and causing increased production costs. The consolidation process also contributes to the relatively unreliable performance of currently available military tracer ammunition. Military specifications usually set forth the common "trace" requirement that ninety to ninety-five percent of the tracer projectiles actually trace at a reliability level of ninety percent. Ammunition manufacturers have experienced difficulties in meeting such standards. The presently employed consolidation process and the use of standard metal-oxidizer chemical formulation has led to various ammunition malfunctions such as "blinds" (wherein there is no tracing at all), short traces, dim traces or even the ejection of all or part of the pyrotechnic composition during flight (usually called "popout"). Further difficulties have been experienced by prior workers in the art because the proper functioning of many tracer compositions exhibited an undesirable dependence on the ambient temperatures.

Additionally, inasmuch as present small-arms tracer projectiles often do not or can not have the same exterior ballistics as the companion (non-tracer) projectiles such as ball projectiles or HE projectiles, which they must simulate in flight trajectory, it will be appreciated that other design and manufacturing problems exist which have not been fully mastered by those skilled in the art of tracer ammunition production.

It has been found by prior workers in the field that the reliability of ignition and the burning time of a tracer is a sensitive function of several manufacturing and environmental variables. The tracer assembly takes up critical space in the round as a whole and is not readily compatible with other ammunition types. Further, the tracer functioning can perturb the exterior ballistics, and because of this, tracer sub-caliber rounds for large caliber systems or the same caliber tracer rounds for small caliber systems can experience ballistic mismatches as compared with the main or non-tracer round when in flight.

Additionally, the presently available tracer ammunition usually exhibits poor visibility at long ranges from the gunner's location. The relatively large pyrotechnic display of the presently available tracer ammunition provides a close range of visibility which may serve as a locater and thus permit enemy detection of the firing source. Accordingly, many gunners have been faced with the choice of disgarding tracer ammunition entirely and thus losing the accuracy and locating affect of the tracer rounds or else, by employing the tracer ammunition for accuracy purposes, they might then find themselves unduely attracting return fire because of the locater effect of the tracers. Further, it has been found that in many instances, certain chlorinated ingredients of current tracer compositions have histories of manifesting carcinogenic effects during manufacturing, thereby possibly creating a considerable job hazard Additionally, as above set forth, automated tracer manufacturing procedures have not heretofore been available and accordingly, the cost of tracer ammunition manufacturing is considerably greater than that of the main, non-tracer rounds.

It is therefore an object of the present invention to provide an improved tracer ammunition of the type set forth.

It is another object of the present invention to provide a novel tracer ammunition featuring pyrotechnic columns including means to produce long burning times with highly intense displays visible over long ranges.

It is another object of the present invention to provide a novel small arms tracer ammunition which can be manufactured utilizing the same equipment and the same manufacturing techniques which are employed when manufacturing the non-tracing rounds.

It is another object of the present invention to provide a novel tracer ammunition featuring a pyrotechnic column characterized by a length-to-diameter ratio which exceeds the value of five.

It is another object of the present invention to provide a novel tracer ammunition including a pyrotechnic column of small diameter and means to slow the burning rate of the pyrotechnic column.

It is another object of the present invention to provide a novel method of manufacturing an improved tracer ammunition wherein the need for a drilled hole ro receive a pyrotechnic composition in the base of the projectile can be eliminated.

It is a further object of the present invention to provide a metal encased tracer element for use in cannon caliber ammunition.

It is another object of the present invention to provide a novel tracer ammunition and an improved method of manufacturing the same.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a cross sectional view, partly in elevation, showing a conventional, prior art type of tracer round.

FIG. 2 is an enlarged, partial, side elevational view of continuous cord containing a continuous, small diameter pyrotechnic column, and partially broken away to expose interior construction details.

FIG. 3 is a side elevational view of a segment of the cord of FIG. 2, cut to the desired length, and partially broken away to expose interior construction details.

FIG. 4 is an enlarged, cross sectional view taken along line 4—4 on FIG. 3, looking in the direction of the arrows.

FIG. 5 is a side elevational view of the segment of FIG. 3, partially broken away, showing a preformed, tracer charged lead slug.

FIG. 6 is a cross sectional view showing the preformed slug of FIG. 5 inserted within a bullet jacket, and partly in elevation to illustrate the jacket crimp.

FIG. 7 is a cross sectional view taken along line 7—7 on FIG. 6, looking in the direction of the arrows.

DESCRIPTION OF THE PREFERRED EMBODIMENT OF THE INVENTION

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a prior art type of tracer bullet 10 which includes generally a brass or other metal jacket 12 which is shaped to the desired configuration for the desired path of flight. A point filler 14 completely fills the forward portion of the jacket 12 and preferably, the filler material can be formed of lead in the known manner.

The forward end 16 of the jacket 12 is generally pointed in configuration and the rearward end 18 of the jacket is blunt and is provided with a rear opening 20. The rearward portion of the lead filler 14 is drilled or otherwise treated to define a concentric opening 24. Through the rear opening 20 is inserted under pressure a pyrotechnic composition or tracer 22 to fill the slug opening 24. In the illustrated embodiment, the pyrotechnic composition is inserted into the lead. In other configurations, a pyrotechnic composition can be loaded through the jacket rear opening 20 to abut directly the rear end of a shortened lead slug 14 in face to face contact. When required, tne rearward end of the tracer composition 22 can be drilled or otherwise worked to provide an opening for receipt therein of an igniter composition 26. In some types of tracers, if necessary, a sub-igniter composition 28 can also be provided to assure ignition of the pyrotechnic composition 22. A closure disc 30 may be provided rearwardly of the pyrotechnic composition 22, the igniter 26 and sub-igniter 28 in a manner to close the rear jacket opening 20 and to facilitate the manufacturing process. Preferably, a peripheral crimp 32 is provided in the jacket 12 to secure the jacket to the lead slug 14. In known manner, the peripheral crimp may be provided with a knurled cannelure 34 to aid in the mechanical bonding of the parts.

Referring now to FIGS. 2–5, a series of operations for forming a preformed tracer charged lead slug in accordance with the present invention can now be described. A continuous pyrotechnic composition filled cord 36 can be formed by employing a continuous reel lead, or lead-antimony alloy wire or any other soft metal such as aluminum, copper, etc. and then drilling or otherwise providing a continuous, concentric hole 38 therethrough. Optionally, a tube of lead, lead-antimony alloy or aluminum, etc. with relatively thick side walls and relatively small diameter longitudinal opening can be employed. The concentric, central opening 38 can then be filled with a suitable pyrotechnic formulation and the two ends of the cord can be closed with lead or antimony-lead stoppers. The continuous cord 36 with the filled pyrotechnic composition is then swaged down in size to the desired final diameter, which diameter usually is the inside diameter of the projectile jacket. Preferably, this size will be the same size as the lead cord material usually employed in the conventional manufacture of ball-type ammunition and accordingly, the same manufacturing techniques usually employed with ball-type ammunition can be utilized when manufacturing tracers. It is noteworthy that there is no need to individually drill a rear opening in each round, nor to insert a suitable pyrotechnic composition into that hole under considerable pressure. Thus, the manufacture of tracers will take no longer than the manufacture of non-tracer ammunition.

In the manufacturing process, after the continuous cord 36 is swaged or drawn down to the desired outside diameter, the cord is cropped or cut into slug size segments 42 as illustrated in FIG. 3. As shown in FIGS. 3 and 4, each segment 42 contains an outer lead or lead-antimony slug 44 with a concentric, pyrotechnic column 46 therewithin. The pyrotechnic column 46 extends throughout the length of the slug 44. As best seen in FIG. 5, after cropping, the slug 44 can be shaped in known manner to provide a generally pointed front end 48 and generally cylindrical rear end 50 of size to allow loading into a brass jacket 12 using conventional ammunition manufacturing equipment. See FIG. 6.

In the preferred embodiment, the pyrotechnic column 46 illustrated in FIG. 5, after swagging or drawing down the cord 36 to the required size, preferably measures between 0.025 inches to 0.035 inches in diameter and the core loading density of pyrotechnic material is between approximately eight grains per linear foot and twelve grains per linear foot. The relatively small diameter of the pyrotechnic column surprisingly produces an improved tracer capable of yielding a highly intense, yet distinct line of light along the trajectory which is visible over a range 140% greater than that of conventional tracers. The tracer of the present invention is visible to the gunner within a ±20° angle from the trajectory, but due to its small diameter, is not visible to the enemy.

In view of the extremely small diameter of the pyrotechnic column 46, the pyrotechnic composition 40 must be of a type that will burn brightly at a controlled rate, that will burn for a sufficient length of time to permit visual observation over the entire range and that will not be subject to burn-outs or misfiring. In order to produce a satisfactory pyrotechnic composition capable of meeting this criteria, numerous tests have been conducted and the compositions employed in each test are set forth below. In each test, various compositions by weight of zirconium powder, potassium perchlorate and a polyester binder have been employed. In each instance, the zirconium powder employed was finely divided through a forty micron sieve, granular type one, meeting the requirements of Mil-399, class 3. The potassium perchlorate utilized was "primer grade", sieved through a sixty mesh sieve size, meeting the requirements of Mil-P-217, grade A, class 3. The polyester binder was type B, high strength. An alternate binder comprising vinyl alcohol acetate resin (VAAR) as manufactured by Union Carbide Company, company specification US-MA-28-18, 28% solids was also tested in the first three compositions. The following compositions expressed in percentage by weight were tested:

| INGREDIENT | TEST NUMBER | | | | | | | |
|---|---|---|---|---|---|---|---|---|
| | 1 | 2 | 3 | 4 | 5 | 6 | 7 | 8 |
| zirconium powder | 69.3 | 69.0 | 68.7 | 58 | 38 | 77.5 | 65 | 62.5 |
| potassium perchlorate | 29.6 | 29.4 | 29.3 | 38 | 58 | 17.5 | 25 | 22.5 |
| VAAR or polyester binder | 1.1* | 1.6* | 2.0* | 4.0 | 4.0 | 5.6 | 10 | 15 |

*Compositions tested with VAAR binder

Of the above tested compositions, it has been determined that the compositions of Tests 1, 2 and 3, using the VAAR binder and the compositions of Tests 7 and 8 using the polyester binder have proved to be most satisfactory for the purpose and these compositions have been designated by the applicants as LSI-PT-44, LSI-PT-45, LSI-PT-46, LSI-PT-47 and LSI-PT-48.

Referring now to FIG. 6, utilizing the formed and shaped slug 44' of FIG. 5, the slug can be loaded into the open rear of the brass jacket 52 by employing the usual equipment utilized to load lead rounds (not shown) in substantially the same manner and in substantially the same amount of time. After the interior of the brass jacket 52 is loaded with the slug 44', the medial crimp 32 can be applied about the periphery of the jacket to secure the parts together. At the same time, in the manner previously described, a knurled cannelure 34 can also be formed. Additionally, if desired, the rear end 58 of the jacket 52 can be pressed, molded or otherwise formed to provide conventional boattail 56. Thus it is seen that a finished tracer round 60 can be provided having a pyrotechnic column 46 of relatively thin diameter extending the entire length of the tracer round 60.

Also, it will be noted that during the formation of the tracer round 60, there was no requirement for any drilling or filling operations. Accordingly, after the production of the formed slug 44' of FIG. 5, conventional ammunition manufacturing equipment can be utilized in the usual manner to form the tracer ammunition of the present invention. Additionally, it will be noted that the pyrotechnic column 46 extends the entire length of the jacket 52 and that the diameter of the pyrotechnic column 46 is relatively small in comparison to the diameter of the lead or lead-antimony slug. Additionally, in view of the fact that the pyrotechnic column 46 extends the entire length of the slug, there is no tendency or possibility of the pyrotechnic material separation from the lead or lead-antimony slug. By employing the peripheral crimp 32 to secure the slug within the jacket, assurance can then be made that the pyrotechnic column will also be secured to the jacket.

It will be noted that the lead slug 44' completely surrounds the pyrotechnic column 46 for its entire length and fills the entire interior cavity of the jacket. The lead slug 44' then acts as a heat sink in a manner to control and slow the rate of burning of the pyrotechnic column 46. As heat is generated upon ignition of the pyrotechnic column, a significant portion of the heat will be absorbed into the surrounding heat sink material, thereby slowing the rate of combustion of the pyrotechnic material to assure tracer burn over the entire range.

As above set forth, in accordance with the teachings of the present invention, the ratio of the length of the pyrotechnic column to the diameter of the column is greater than five. This results in an elongated pyrotechnic column of very small diameter. For example, for 22 cal. ammunition, a pyrotechnic column having a diameter of approximately 0.030 inches has been satisfactorially tested.

In view of the small diameter of the pyrotechnic column, the applicants' compositions LSI-PT-44, LSI-PT-45, LSI-PT-46, LSI-PT-47 and LSI-PT-48, have been selected for their reliability in ignition an their intense burning rate. Because of the relatively large mass to pyrotechnic ratio, upon ignition, the unique thermal characteristics of the tracer ammunition comes into effect, even for small caliber rounds, and the heat of the reaction is driven off into the surrounding lead, lead-antimony, aluminum or other soft metal sidewalls. The sidewalls function as a heat sink to thereby slow down the speed of reaction to assure trace over the entire flight path.

A pyrotechnic loading of approximately ten grains per foot has been found most satisfactory for the purpose and a range of between eight grains per foot to approximately twelve grains per foot have provided workable results. When pyrotechnic compositions below a loading factor of eight grains per foot have been tested, ignition problems have developed and the tracer composition was unreliable. When composition loadings in excess of twelve grains per foot were attempted, it was found that the composition burned too quickly and it was not possible to assure trace over the entire path of flight.

Although the present invention has been described with reference to the particular embodiments herein set forth, it is understood that the present disclosure has been made only by way of example and that numerous changes in the details of the construction may be resorted to without departing from the spirit and scope of the invention. Thus, the scope of the invention should not be limited by the foregoing specification, but rather, only by the scope of the claims appended hereto.

We claim:

1. A tracer ammunition round having a propellant charge comprising a hollow jacket having a generally pointed front end and a generally blunt rear end, the jacket defining a shaped interior cavity;

a shaped slug inserted into the jacket cavity, the slug comprising a metallic body, the body comprising a forward end, a rearward end and an elongated, cylindrical, central opening, the central opening extending longitudinally through the entire length of the body from the forward end to the rearward end, the rearward end being exposed to the propellant charge, the ratio of the length of the central opening to the diameter of the central opening being at least five; and a pyrotechnic composition within the central opening an d completely filling the central opening, the pyrotechnic composition comprising a fuel, an oxidizer and a binder, the pyrotechnic composition being capable of being ignited by the propellant charge upon firing to provide a visible trace of the trajectory of the round, the pyrotechnic composition defining an elongated, small diameter, pyrotechnic column, the pyrotechnic column having a diameter about 0.035 inches, the ratio of the mass of the slug to the mass of the pyrotechnic column being sufficiently large to cause the slug to act as a heat sink to slow down the speed of reaction of the pyrotechnic composition, whereby the small diameter pyrotechnic column and the heat sink effect of the slug combine to provide an extended trace burn time.

2. The tracer round of claim 1 wherein the pyrotechnic composition comprises zirconium powder, potassium perchlorate and a binder.

3. The tracer round of claim 2 wherein the zirconium powder comprises between 68.7 percent and 69.3 percent by weight of the pyrotechnic composition.

4. The tracer round of claim 3 wherein the potassium perchlorate comprises between 29.3 percent and 29.6 percent by weight of the py rotechnic composition and wherein the binder is vinyl alcohol acetate resin.

5. The tractor round of claim 2 wherein the zirconium powder comprises between 62.5 percent and 65 percent by weight of the pyrotechnic composition.

6. The tracer round of claim 5 wherein the potassium perchlorate comprises between 22.5 percent by weight of the pyrotechnic composition and wherein the binder is a polyester binder.

7. The tracer round of claim 1 wherein the ratio of length to diameter of the pyrotechnic column is between five and two hundred.

8. The tracer round of claim 1 wherein the quantity of pyrotechnic composition within the pyrotechnic column is between eight and twelve grains per linear foot of column.

9. The tracer round of claim 1 wherein the ratio of the diameter of the slug to the diameter of the pyrotechnic column is at least about 6.

* * * * *